US006708916B2

(12) United States Patent
Ueyama et al.

(10) Patent No.: US 6,708,916 B2
(45) Date of Patent: Mar. 23, 2004

(54) METHOD OF WINDING SHEET WEB COATED WITH PRESSURE-SENSITIVE ADHESIVE

(75) Inventors: Minoru Ueyama, Katano (JP); Toshiaki Miyoshi, Izumi (JP)

(73) Assignee: Fuji Tekko Co., Ltd., Neyagawa (JP)

( * ) Notice: Subject to any disclaimer, the term of this patent is extended or adjusted under 35 U.S.C. 154(b) by 0 days.

(21) Appl. No.: 10/094,359

(22) Filed: Mar. 8, 2002

(65) Prior Publication Data

US 2003/0071161 A1 Apr. 17, 2003

(30) Foreign Application Priority Data

Oct. 11, 2001 (JP) ..... 2001-313385

(51) Int. Cl.[7] ..... B65H 19/28

(52) U.S. Cl. ..... 242/533.4; 242/527.2; 242/532.3; 242/533.5

(58) Field of Search ..... 242/527.2, 532.3, 242/533.4–533.6

(56) References Cited

U.S. PATENT DOCUMENTS 3,784,122 A * 1/1974 Kataoka ..... 242/525.7
5,221,056 A * 6/1993 Walliser et al. ..... 242/525.7
5,735,481 A * 4/1998 Loosen ..... 242/526.1
5,845,867 A * 12/1998 Hould et al. ..... 242/527
6,269,859 B1 * 8/2001 Semba ..... 156/457

FOREIGN PATENT DOCUMENTS

| | | | | |
|---|---|---|---|---|
| EP | 0 073 909 | | 3/1983 | |
| JP | 58139953 A | * | 8/1983 | ..... B65H/19/22 |
| JP | 2001-240279 | | 9/2001 | |
| JP | 2001240279 A | * | 9/2001 | ..... B65H/19/28 |

* cited by examiner

*Primary Examiner*—Kathy Matecki
*Assistant Examiner*—Sang Kim
(74) *Attorney, Agent, or Firm*—Flynn, Thiel, Boutell & Tanis, P.C.

(57) ABSTRACT

In winding up a sheet web coated with a tacky adhesive, a roll changing method is provided which obviates the necessity of applying an adhesive. When changing the sheet web from a full wind roll wound up on a turret winder to a new core tube, the new core tube is revolved in reverse to the rotational direction of the turret, the sheet is cut between the full wind roll now turned by the turret and the new core tube revolving in reverse to it at a winding location, the adhesive side of the end of the cut sheet in the running direction is pressed and attached to the surface of the new core tube under reverse revolution and concurrently, the attached sheet is folded back, and the sheet web continuing from it is wound onto the new core tube, with its adhesive side being a surface side.

1 Claim, 3 Drawing Sheets

METHOD OF WINDING SHEET WEB COATED WITH PRESSURE-SENSITIVE ADHESIVE

BACKGROUND OF THE INVENTION

1. Field of the Invention

This invention relates to an improvement in a method of winding up a sheet web coated on its one side with a pressure-sensitive adhesive on a core tube with the adhesive side being a surface side.

2. Description of Related Art

Such rollers that are produced by winding up a sheet coated on its one side with a pressure-sensitive adhesive on a core tube so that the adhesive side may be a surface side are widely used in daily life, for example, as a gum roller for catching dust or refuse in a carpet, etc. This kind of roller was hitherto produced as shown in FIGS. 4 and 5 by winding up the aforesaid sheet or a film F fed continuously through a touch roller 11 on a core tube C revolving in the same direction as a turret T. When changing the sheet web from a full wind roll R to a new core tube $C_1$, the new core tube $C_1$ was subjected preliminarily to adhesive treatment such as a hot melt adhesive (made of cloth or the like) or a pressure-sensitive adhesive double coated tape, the sheet was cut between the full wind roll R and the new core tube $C_1$ with a cutting blade 12, and the leading end of the cut sheet (non-adhesive side) was wrapped on the new core tube $C_1$ at its adhesive side, thereby being bonded.

With the sheet coated with a pressure-sensitive adhesive as mentioned above, however, its pressure-sensitive adhesive side was, upon winding, an outer side to the core tube and its back side was subjected to a mold releasing treatment. Because of that, even if the new core tube was preliminarily subjected to the adhesive treatment, only a poor adhesion to the new core tube was obtained, and hence an improvement was demanded.

In order to cope with the problem in the conventional method above, the present applicant has proposed a method of improving the adhesiveness of the cut end of the sheet without the necessity of treating a new core with a hot melt adhesive or pressure-sensitive adhesive double coated tape and of enhancing the workability in a continuous winding of the sheet.

In winding up a sheet web coated with the aforesaid adhesive, this method comprises, when changing the sheet from a full wind roll wound up from the sheet web continuously fed to a winding position in a predetermined length to a new core tube, cutting the sheet web between the full wind roll moved and the new core tube located at the winding position, and simultaneously pressing and attaching the adhesive end of the cut sheet, while being in the running direction of the sheet web, to the new core tube and thereafter revolving the new core tube in reverse to the running direction of the sheet web and winding the attached sheet web onto the new core tube with the adhesive side being a surface side (JP P2001-240279A).

However when carrying the proposed method into effect, there has been a difficulty in workability upon roll changing and from the viewpoint of more effective roll changing, a further improvement over the method has been found to be necessary.

The invention has therefore been made by further developing the proposed method, and it is an object of this invention to facilitate changing the sheet web from a full roll to a new core tube, to smooth the continuous winding operation and to enhance the working efficiency.

SUMMARY OF THE INVENTION

The invention for attaining the aforesaid object resides in a method of winding continuously a sheet web coated on its one side with a pressure-sensitive adhesive onto a core tube on a turret winder, with the adhesive side being a surface side, which method is characterized in that when changing the sheet web from a full wind roll obtained by winding up the sheet web fed continuously to a winding position in a predetermined length to a new core tube, the new core tube is revolved in a reverse direction to the rotational direction of the turret, the sheet web is cut between the full wind roll moved by the rotation of the turret and the new core tube located at the winding position and revolving in the reverse direction to the rotational direction of the turret, the cut end of the sheet web being in the running direction of the sheet web is pressed and attached, at its adhesive side, to the surface of the new core tube under revolution in the reverse direction and concurrently, the attached sheet is folded back by the revolution of the new core tube in the reverse direction, and the sheet web continuing from the folded back portion is wound onto the new core tube, with the adhesive side being a surface side.

According to the method of the invention as described above, while the pressure-sensitive adhesive coated sheet web being fed is in the running direction of the sheet web accompanied by the rotation of the turret, its adhesive side comes into contact with the surface of a new core tube under revolution in the reverse direction to the rotational direction of the turret and the sheet web is cut with a cutting blade. Simultaneously with cutting, the leading end of the cut sheet web is bonded to the new core tube by taking advantage of the adhesive side. At that time because the revolution direction of the new core tube is reverse to the running direction of the sheet web accompanied by the rotation of the turret, the sheet web is folded back as soon as it is partly bonded and the sheet web continuing from the folded back portion will be wound on the new core tube with the adhesive side being a surface side.

BRIEF DESCRIPTION OF THE DRAWINGS

The embodiments of the invention will be hereinafter described in more detail, relying on one example of an apparatus for carrying out the method as shown in the accompanying drawings, in which.

DESCRIPTION OF PREFERRED EMBODIMENTS

Figure 1:
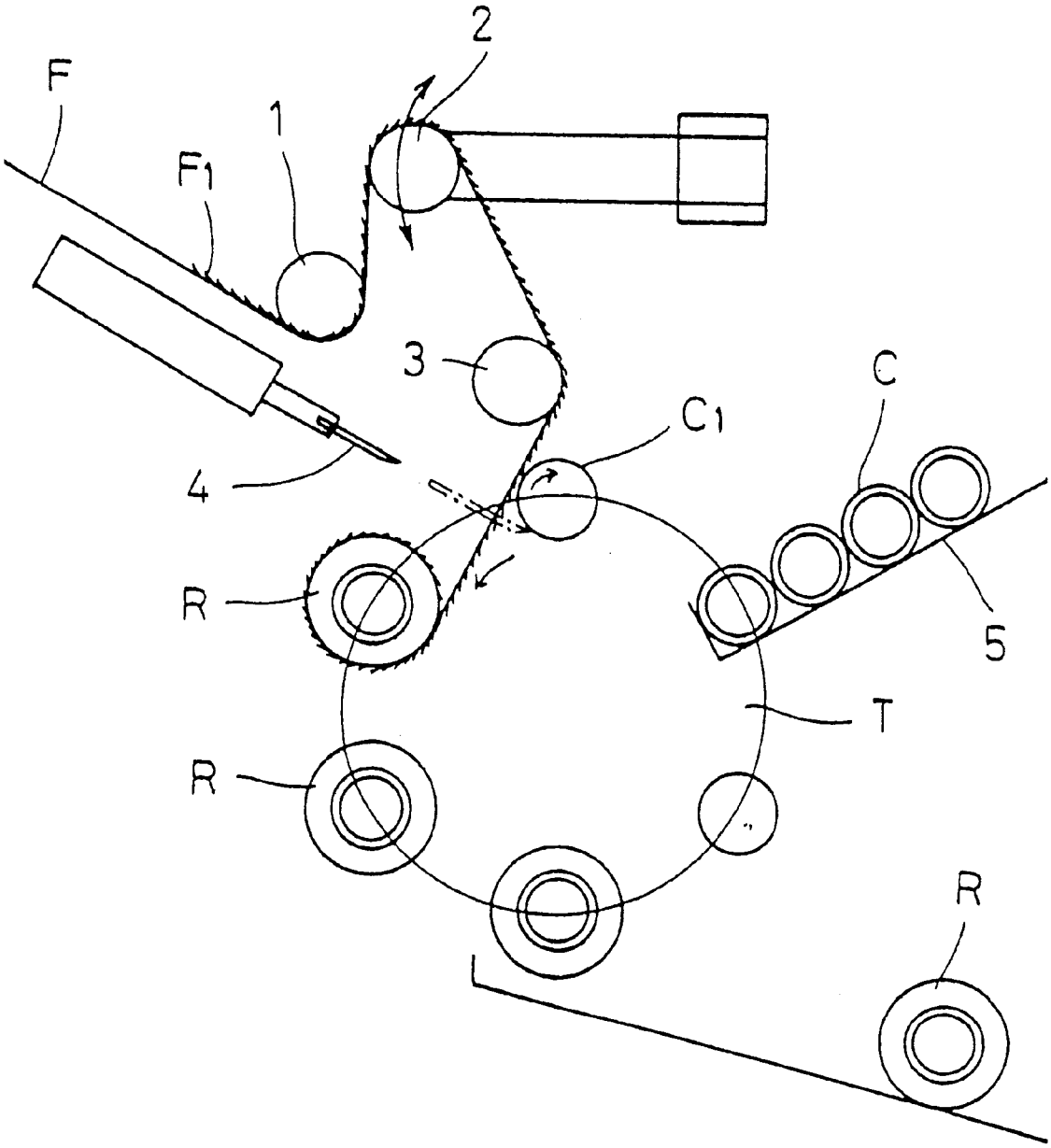
FIG. 1 is a schematic view of a winding apparatus for carrying out the invention showing essential parts thereof.
Figure 2:
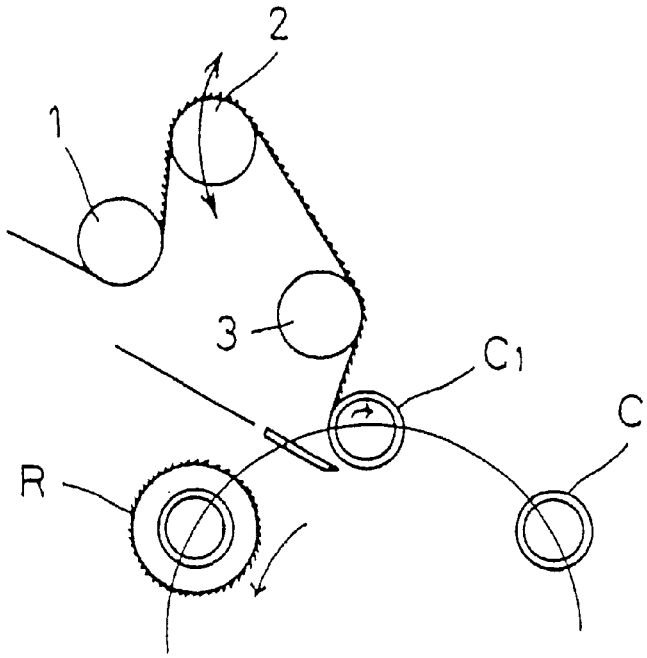
FIG. 2 is an illustration showing the state when the sheet web is cut in the apparatus of FIG. 1.
Figure 3:
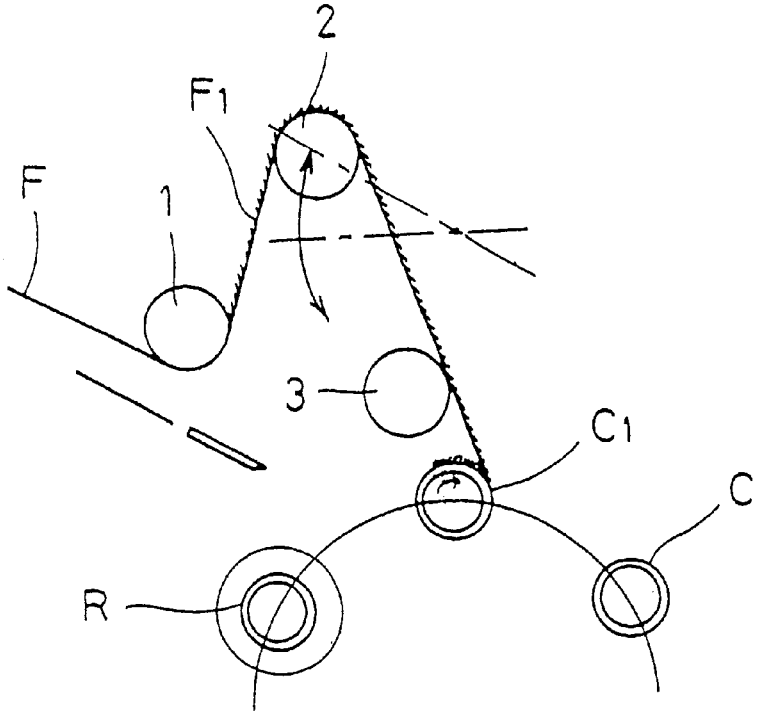
FIG. 3 is an illustration showing the state when after cutting, the sheet is wrapped around a new core tube in the apparatus of FIG. 1.
Figure 4:
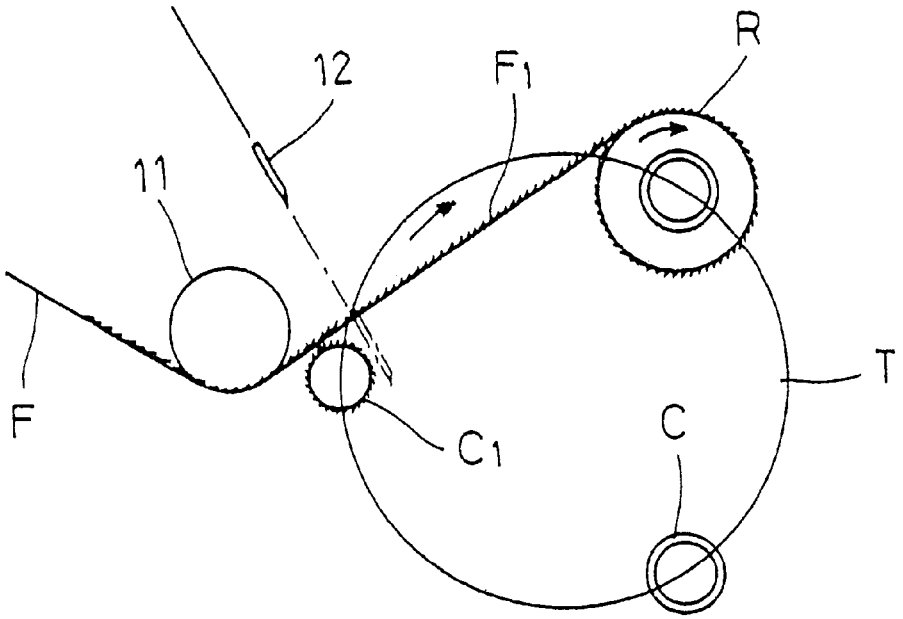
FIG. 4 PRIOR ART
FIG. 4 is a schematic view of a conventional winding apparatus showing essential parts thereof.
Figure 5:
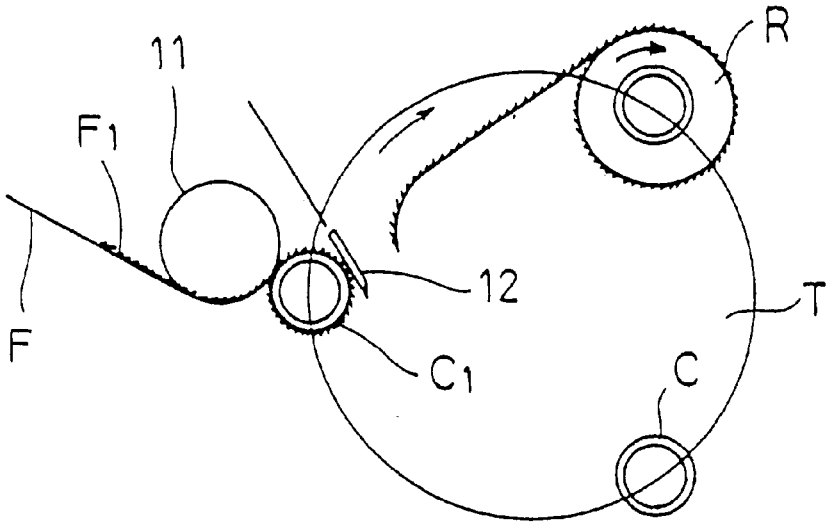
FIG. 5 PRIOR ART
FIG. 5 is an illustration showing the state upon roll changing in the conventional apparatus of FIG. 4.

The winding apparatus for carrying the invention method into effect is adapted and constructed, as shown in FIG. 1, so that a sheet web F fed continuously from the previous step, whose pressure-sensitive adhesive coated side F1 is a surface side, is passed through guide rollers 1,3 and wound onto a core tube C located on a turret board T. Between the guide rollers 1,3 there is provided a cancer roller 2 capable of swinging which serves to feed the sheet web after passing the first guide roller 1, while riding it thereon, to the second guide roller 3 so that a sagging of the sheet web between both guide rollers 1,3 can be absorbed.

The core tubes C are adapted to be supplied in sequence through a supply station 5 to a predetermined location of the turret T. A cutting blade 4 is provided to cut the sheet web running between the winding location and the shifting location of a full wind roll R so as to be able to freely protrude or retract.

On the other hand, the full wind rolls R are shied in turn by the rotation of the turret T and released onto a receiving table at a predetermined releasing location, followed by feeding to the next step.

In the winding apparatus, according to this invention, the core tube C and the turret T are adapted to be rotated mutually in reverse directions. In the example illustrated, the rotational direction of the core tube C, namely the winding direction is clockwise whereas the turning direction of the turret T is counterclockwise; both are rotated always in reverse directions during operation.

It is an essential feature of this invention that the rotational direction of the core tube C and the turning direction of the turret T be in mutually reverse directions. It is another essential feature of the invention that when the sheet web fed via the second guide roller 3 makes contact with the surface of a new core tube $C_1$, which is now moved to the winding position and revolving in the reverse direction, between the second guide roller 3 and the full wind roll R shifted to the next location by the rotation of the turret and cut with the cutting blade 4 between the new core tube $C_1$ and the full wind roll R, the trailing end of the sheet wound on the full wind roll R be wrapped around the full wind roll R while the leading end of the cut sheet be applied and attached at its adhesive side to the new core tube $C_1$.

Because of the aforementioned features, the leading end of the cut sheet F is attached, at its adhesive side $F_1$, partly to the new core tube $C_1$ revolving in the reverse direction. By the rotation of the new core tube in the opposite direction, the sheet web continuing from the attached portion is folded back and will be wound onto the new core tube $C_1$, with the adhesive side $F_1$ being a surface side.

That is, with the turning of the turret T the full wind roll R is moved and the sheet being in the running direction is applied to the new core tube revolving in the reverse direction. Because of the revolution of the new core tube in the reverse direction, as soon as the sheet is attached to the new core tube, the sheet is folded back and thereafter the winding is started with the adhesive side being a surface side.

The method of this invention thus takes advantage of the adhesive coated on the surface of the sheet web thereby wrapping the sheet on the new core tube. Therefore the necessity of applying a pressure sensitive adhesive on a surface of the new core tube, as is the case with the conventional method is any longer obviated.

As described above, the present invention comprises pressing or applying the adhesive side of the sheet web being fed onto the surface of the new core tube revolving in the reverse direction to the rotation of the turret, cutting the sheet between the new core tube and the full wind roll R, and winding the sheet web on the new core tube so that the adhesive side may be a surface side. When cutting and changing the sheet web from the full wind roll to the new core, the sheet being fed is in contact with and is pressed to the new core tube revolving in the reverse direction to the running direction of the sheet and wound up, so that the cut end partly attached by pressing is folded back immediately and can be wound readily, with the adhesive side being a surface side. Moreover even if the new core tube is always revolved upon roll changing to the new core tube, there is no inconvenience in winding. There is no necessity of applying newly a coating treatment of an adhesive upon roll changing, which was a case with the conventional sheet coated with a pressure-sensitive adhesive. It is possible to obtain effectively an adhesive coated sheet roller that is highly reliable in adhesiveness and stable in quality, in contrast to the conventional adhesiveness to the mold release treated surface.

Upon wrapping, the leading end of the sheet is wrapped on the new core tube revolving in reverse to the running direction of the sheet, so that there is little difficulty albeit the sheet may be instantaneously sagged and accordingly, it is possible to wrap the sheet on the new core tube without sagging it.

What is claimed is:

1. A method of continuously winding a sheet web coated on an upper surface side with a pressure-sensitive adhesive onto a core tube on a rotating turret winder in which the sheet web is transferred onto a new core tube after a predetermined amount of the sheet web has been wound on a preceding core tube to form a full wind roll, characterized in: revolving the new core tube in a direction opposite to the rotational direction of the turret; cutting the sheet web between the full wind roll, moved by the rotation of the turret, and the new core tube provided at a winding position and still revolving in the opposite direction, applying and attaching the adhesive side of the sheet web onto a surface of the new core tube while the new core tube is revolving in the opposite direction so that the attached sheet web is folded back by the revolution of the new core tube in the opposite direction; and winding the sheet web extending from the attached sheet web onto the new core tube such that the adhesive side is facing upward.

* * * * *